United States Patent [19]

Monzo Gomez

[11] Patent Number: 4,486,263

[45] Date of Patent: Dec. 4, 1984

[54] SUPPORT FOR A TAPE WHICH IS ADHESIVE ON ONE OR BOTH OF ITS FACES

[76] Inventor: Peregrin Monzo Gomez, Avda. de Suecia, n°21 Valencia, Spain

[21] Appl. No.: 483,512

[22] Filed: Apr. 11, 1983

[30] Foreign Application Priority Data

Apr. 15, 1982 [ES] Spain ..... 264528

[51] Int. Cl.[3] ..... B32B 31/04; B32B 35/00

[52] U.S. Cl. ..... 156/523; 156/577; 156/579

[58] Field of Search ..... 156/523, 527, 577, 579, 156/574, 576

[56] References Cited

U.S. PATENT DOCUMENTS

| | | | |
|---|---|---|---|
| 2,493,737 | 1/1950 | Burns | 156/577 |
| 2,532,596 | 12/1950 | Bobrov | 156/523 |
| 2,755,953 | 7/1956 | Vogt | 156/527 |
| 2,767,872 | 10/1956 | Laverty | 156/523 |
| 3,310,452 | 3/1967 | Hartley et al. | 156/523 |

*Primary Examiner*—Michael Wityshyn

*Attorney, Agent, or Firm*—Ostrolenk, Faber, Gerb & Soffen

[57] ABSTRACT

A tape dispenser is disclosed in which the tape may be cut within the housing of the dispenser. A roll of the tape is mounted within the housing on a roll holder with a central notch through which a pin extends. A spring in the notch controls the displacement of the roll holder. The tape extends from the roll around a guide roller in relation to which the roll is held in position by the pin. From the guide roller, the tape extends past a blade to a pressure roller which is used to apply the tape to a surface. The blade may be actuated to cut the tape by a pivoting button which protrudes outside the housing, but the blade is held away from the tape by a spring. Between the guide roller and the blade may be mounted a floating roller on a toothed pin. As the tape is rolled onto the surface, the floating roller moves into the housing, bringing the tape to a position in which the blade can cut it without emerging from the housing. The floating roller is on a toothed pin which is mounted between two openings in the housing wall, and at least one tooth in one of these openings engages the toothed pin, causing it to drop into the housing as it turns.

7 Claims, 6 Drawing Figures

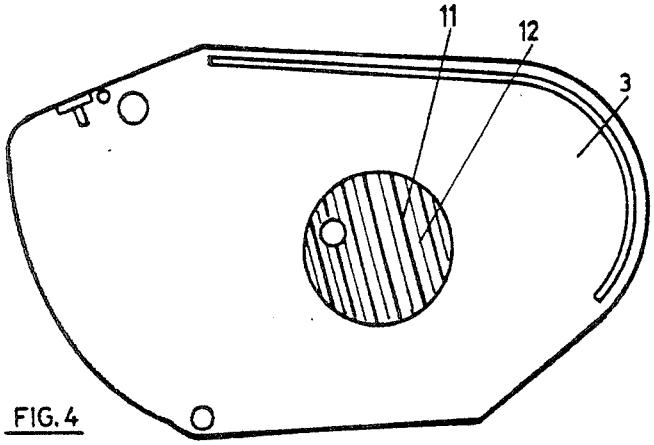
FIG. 4
FIG. 3
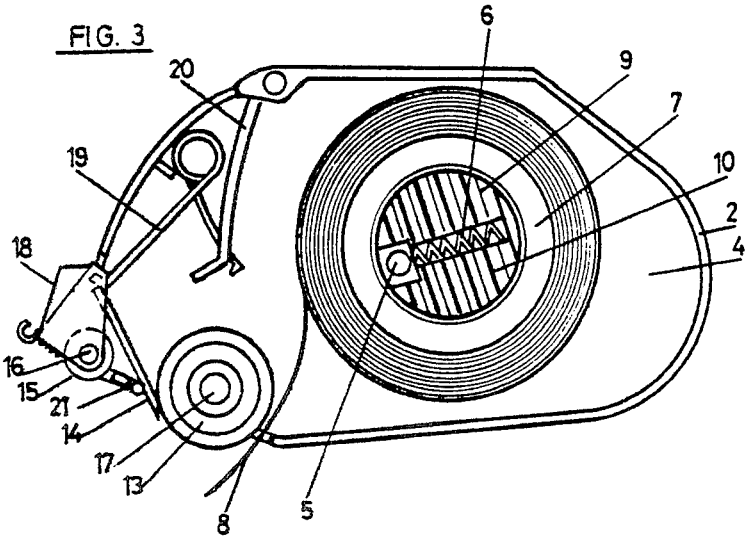

SUPPORT FOR A TAPE WHICH IS ADHESIVE ON ONE OR BOTH OF ITS FACES

BACKGROUND OF THE INVENTION

The present invention relates to a support or dispenser for a tape which is adhesive on one or both of its faces, and particularly to a dispenser wherein the cutting of the tape is effected automatically by a blade which is suitably mounted on the support.

Desktop adhesive tape supports are already known. With this type of support, the user must detach the tape from the roll and then cut it by pressing it against a stationary cutting device which is carried by the dispenser.

This involves certain difficulties in use and in the placing of the tape on the surfaces to be taped or connected together.

Another drawback is that in this type of support, after the last use, the free end of the tape of the roll customarily sticks on. The user encounters difficulties upon the following use of the tape since he must detach the stuck end. In most cases an auxiliary tool is required which he ordinarily does not have at hand. In that case he uses his nail, thereby damaging a part of the tape, which must be discarded. All of this means a loss of part of the adhesive tape.

SUMMARY OF THE INVENTION

The above drawbacks are obviated by the present invention since the support is formed of a substantially prismatic body or housing which is easily handled and permits perfect dispensing, sticking and cutting of the tape without the user himself having to touch it. The roll holder has a central notch in which there is contained a pin on which the roll holder can move. The pin extends inwards from and perpendicular to one of the faces of the support. Within said notch, a spring is suitably arranged in the space between the pin and one of the ends of the notch. This spring regulates the shifting of the roll holder by pushing it in the opposite direction, towards the point where there is located a roller which acts as guide for the tape. The roll holder is positioned at all times by a retaining and sliding device which, in the position of use of the support, sees to the maintenance of the proper ideal distance between the roll holder and the guide roller, depending on the amount of tape remaining on the roll.

This device consists of a sawtooth striation provided on the surface or upper face of the roll holder which cooperates with another facing in the opposite direction provided on the portion of the cover facing the roll holder so that when the roll holder moves towards the guide roller as the tape is used up, the teeth on the two sides facilitate the relative displacement in this direction but lock with each other when the action of the spring tends to move the roll holder in the opposite direction.

The guide roller is positioned on a pin on the bottom wall of the housing, near a lateral opening therein. This opening together with the corresponding portion of the surface of the guide roller defines an outlet passaage for the tape, the end of which is adhered to the corresponding surface to be taped by pressure of the guide roller in the manner that when the latter is turned, the tape is attached and secured by means of a second roller which is close and parallel to the previous one.

In accordance with a variant of the invention, the guide roller is arranged in the interior, and on the outside there is arranged a floating roller which, upon retraction towards the inside, brings the tape to the cutting knife, thereby avoiding the knife's protruding beyond the device unnecessarily when the tape is cut.

The support has an outer shape which can easily fit the hand, having on its front, in its lower end region, a button capable of actuating a knife which is suitably arranged on the inside of the housing.

The button consists of a structure which is mounted for swivelling on the pin of the second roller and which bears the knife. Said structure is urged constantly towards its retracted position by a spring mounted between it and the housing or a rib on the latter. When the button is actuated, by simple inclination of the support, the knife is moved downward between two parallel guides and emerges tangent to the guide roller in order to effect the cutting of the tape.

By way of further explanation of the invention there is described below one practical embodiment of the support, which is merely illustrative and in no way limits the scope of the invention, with reference to the accompanying drawings:

DESCRIPTION OF THE DRAWINGS

FIG. 3 is a view in elevation of the inside of the support without cover;

FIG. 4 is a view of the cover;

DESCRIPTION OF THE PREFERRED EMBODIMENTS

Figure 1:
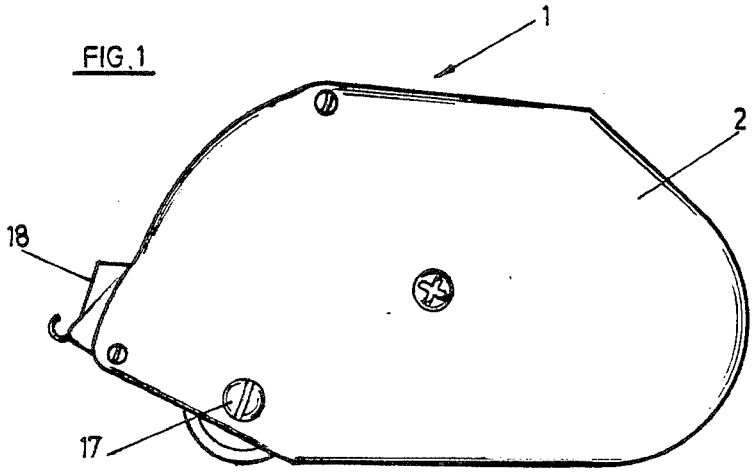
FIG. 1 is a view in elevation of the support.
Figure 2:
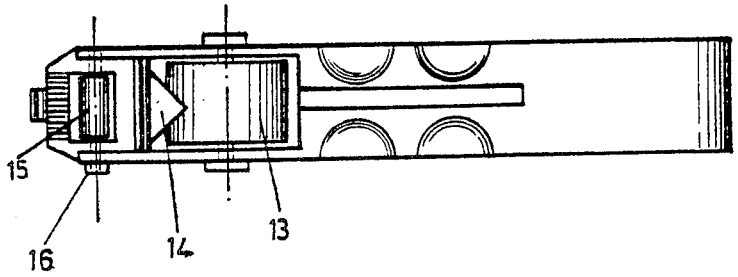
FIG. 2 is a bottom view of FIG. 1.

The support 1 has a prism-shaped housing with irregular base so that it can easily fit the hand, and it is formed of a body 2 and a cover 3.

In the side wall 4 of the body 2 there is a pin 5, arranged in the groove 6 of the roll holder 7 for the tape 8. The roll holder has on its side face 9 sawtooth grooves 10 or simply teeth with which there engage the grooves or teeth 11 provided on the central part 12 of the cover.

The tape 8 passes along the outside of the guide roller 13, extending below the knife 14 which has a sharp pointed cutting region while the roller 15 presses against the adhered tape, securing it on the surface to be taped.

The roller 15 is mounted on a pin 16 parallel to the pin 17 of the guide roller.

Next to the roller 15 there is arranged laterally a button 18 which is mounted for pivoting on the pin 16 of the roller 15 and which is adapted to produce the displacement of the knife blade 14 in order to effect the cutting of the tape 8. This button is constantly urged into its retracted position by the spring 19 which is mounted between it and the rib 20 of the housing.

The knife blade 14 passes in guided fashion between the roller 13 itself and the transverse protrusion 21 in such a manner as to act tangentially to the guide roller.

After the adherence of the tape has been effected, a slight turn of the support is sufficient in order for the button to be actuated and for the cutting of the tape to take place nearly automatically.

On the lower face of the support there are various cutouts which assist in the easy detachment of the adhesive tape when it is desired to use the support.

Figure 5:
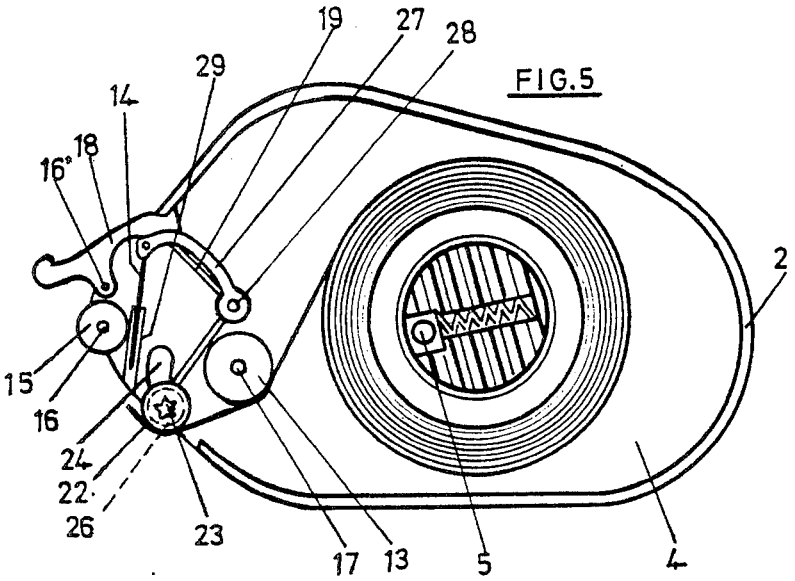
FIG. 5 is a view similar to FIG. 3, showing a variant of the support.
Figure 6:
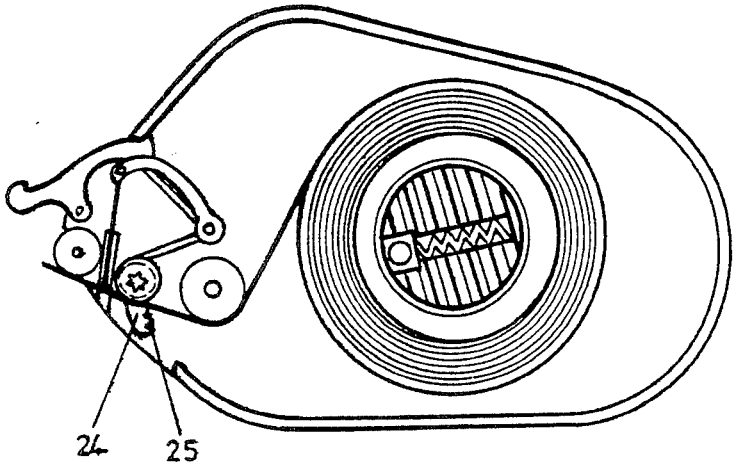
FIG. 6 again shows the support of FIG. 5, but in this case showing the arrangement which it assumes when it is being operated.

In the variant shown in FIGS. 5 and 6, the guide roller 13 is shifted towards the interior and a floating roller 22 is mounted on a toothed pin 23 arranged between two cutouts 24 of angular shape provided with teeth 25 on one of their sides on their inner face. The roller 22 is constantly urged towards its outward position by the spring 19, which in this case is mounted at one end on a peripheral groove 26 in said roller and at the other end on the knife support 27, which is mounted for pivoting, on the pin 28 in the same way as the spring 19. The button 18 is mounted on the pin 16'. The knife 14, which has the shape of an arrow point, cutting from the center towards the sides of the tape, is in this case mounted in the guides 29. With this embodiment, as shown in FIG. 6 the result is obtained that the cutting is effected without it being necessary for the knife to emerge from the support. This result is obtained due to the floating roller 22 which, when it starts to turn, causes its pin 23 to engage with the teeth 25 of the recess 24 against the force of the spring 19, causing it to drop towards the inner groove of the cutouts 24 (position shown in FIG. 6). When the taping has been completed, a simple turn of the support is sufficient in order for the furthest protruding part of the button 18 to come into contact with the surface and turn on the pin 16', driving the support 27 for the knife 14 against the action of the spring 19, causing the emergence of the knife which will effect the cutting of the tape 8.

I claim:

1. A support for a tape which is adhesive on at least one face, comprising:

(A) a housing having a wall, an exit being defined in the wall for exiting a tape from inside the housing;

(B) holding means on the housing wall and spaced apart from the exit for supporting a roll of the tape;

(C) floating roller means for receiving the tape from the roll and for positioning the tape, comprising:

(1) a floating roller on the housing wall and movable between an outward position for positioning the tape in an outer position in the exit and an inward position for positioning the tape in an inner position inward and spaced apart from the exit; and (2) roller urging means for urging the floating roller toward the outward position;

(D) a pressure roller on the housing wall and disposed at the exit for receiving the tape from the floating roller means and for rolling an adhesive face of the tape against a surface for adhering the tape to the surface, the rolling of the tape by the pressure roller causing the floating roller to move toward the inward position; and (E) cutting means for cutting the tape within the housing when the floating roller is in the inward position.

2. The support of claim 1 in which the cutting means comprises:

(1) a blade on the housing wall and movable between a retracted position away from the exit in the housing wall and a protruding position toward but inward from the exit;

(2) blade urging means for urging the blade toward the retracted position; and (3) actuating means for moving the blade from the retracted position to the protruding position; the actuating means being operable for cutting the tape within the housing by moving the blade to the protruding position when the floating roller is in the inward position.

3. The support of claim 2 in which the actuating means comprises a pivotable member pivotally mounted on the housing wall, the pivotable member having a driving part for moving the blade to the protruding position and an end for extending outward from the housing wall on a side of the pressure roller, the support being turnable about the pressure roller toward the side of the pressure roller for causing the pivotable member to contact the surface causing the driving part to move the blade.

4. The support of claim 2 in which the roller urging means and blade urging means together comprise a single spring for both urging the floating roller toward the outward position and urging the blade toward the retracted position.

5. The support of claim 1 in which the floating roller means further comprises dropping means for dropping the floating roller from the outward position to the inward position when the floating roller begins to turn, the dropping means comprising a toothed pin mounted in the floating roller for moving therewith, the housing wall having an opening defined therein for receiving the toothed pin, the housing wall having at least one tooth defined therein and extending into the opening for engaging the toothed pin and for dropping the toothed pin toward the inward position when the toothed pin begins to turn.

6. A support for a tape which is adhesive on at least one face, comprising:

(A) a housing having a wall, an exit being defined in the wall for exiting a tape from inside the housing;

(B) holding means on the housing wall and spaced apart from the exit for supporting a roll of the tape;

(C) guide means on the housing wall for guiding the tape along a path from the roll to the exit;

(D) floating roller means for positioning the tape between the guide means and the exit, the floating roller means comprising:

(1) first and second grooved portions on the housing wall, each having a respective groove defined therein, the respective grooves being spaced apart from each other, the first grooved portion further having at least one tooth defined therein extending into the respective groove;

(2) a floating roller having a striated pin for fitting between the respective grooves of the first and second grooved portions and for engaging the tooth, the floating roller being movable between an outward position for positioning the tape in an outward position in the exit and an inward position for positioning the tape in an inner position inward and spaced apart from the exit; the tooth causing the floating roller to turn as it moves between the outward position and the inward position; and (3) roller urging means for urging the floating roller toward the outward position;

(E) a pressure roller on the housing wall and disposed at the exit for engaging the tape as it exits and for pressing an adhesive face of the tape against a surface for adhering the tape to the surface, the pressing of the tape by the pressure roller causing the floating roller to move toward the inward position; and (F) cutting means for cutting the tape within the housing when the floating roller is in the inward position, comprising:

(1) first and second opposite guides on the housing wall and spaced apart from each other;

(2) a movable blade movably mounted on the first and second guides and having a free end for cutting the tape along the path between the floating roller and the pressure roller, the blade being movable between a retracted position away from the exit and a protruding position toward but inward from the exit;

(3) blade urging means for urging the blade toward the retracted position; and (4) an actuating button for moving the blade from the retracted position to the protruding position for cutting the tape when the floating roller is in the inward position, the actuating button being pivotally mounted on the wall and having a driving part for moving the blade to the protruding position when the button pivots and an end for protruding outside the wall and for receiving a force for causing the button to pivot.

7. The support of claim 6 in which the roller urging means and blade urging means together comprise a single spring for both urging the floating roller toward the outward position and urging the blade toward the retracted position.

* * * * *